US005121702A

United States Patent [19]

Johnson et al.

[11] Patent Number: 5,121,702

[45] Date of Patent: Jun. 16, 1992

[54] UNDERWATER VEHICLE

[75] Inventors: Frederick A. Johnson, Sevenoaks; Malcolm A. Swinbanks, Cambridge; Christopher F. King, Leire, all of United Kingdom

[73] Assignee: GEC-Marconi Limited, Stanmore, United Kingdom

[21] Appl. No.: 663,088

[22] Filed: Feb. 28, 1991

Related U.S. Application Data

[63] Continuation of Ser. No. 375,971, Jul. 6, 1989, abandoned.

[30] Foreign Application Priority Data

Jul. 7, 1988 [GB] United Kingdom ..... 8816189

[51] Int. Cl.[5] ..... B63G 8/14

[52] U.S. Cl. ..... 114/330; 114/332

[58] Field of Search ..... 114/23, 144 L, 152, 114/330, 331, 332, 312, 126, 144 R, 162

[56] References Cited

U.S. PATENT DOCUMENTS

| | | | |
|---|---|---|---|
| 2,143,656 | 1/1939 | Hojnowski . | |
| 2,878,772 | 3/1959 | Kjekstad | 114/126 |
| 2,979,010 | 4/1961 | Braddon et al. | 114/126 |
| 3,727,572 | 4/1973 | Nelson et al. | 114/126 |
| 3,752,103 | 8/1973 | Middleton | 114/338 |

FOREIGN PATENT DOCUMENTS

| | | | |
|---|---|---|---|
| 3503642 | 6/1986 | Fed. Rep. of Germany | 114/332 |
| 390409 | 10/1908 | France . | |
| 0068489 | 3/1988 | Japan | 114/332 |
| 957948 | 5/1964 | United Kingdom . | |

*Primary Examiner*—Sherman D. Basinger
*Attorney, Agent, or Firm*—Spencer & Frank

[57] ABSTRACT

A submarine is provided with a large number of individual fins, some of which are arranged to create a "slot" effect between them. The fins are controlled in a way which is dependent on which of them may be in service at a particular time so that manoeuvreability is substantially unaffected by damage to a limited number of them.

9 Claims, 2 Drawing Sheets

UNDERWATER VEHICLE

This application is a continuation of application Ser. No. 07/375,971, filed Jul. 6th, 1989 and now abandoned.

BACKGROUND OF THE INVENTION

This invention relates to an underwater vehicle, e.g. a submarine.

Conventionally submarines are controlled by two large fins towards the bow of the vessel, two at the stern, and a rudder for controlling its direction. When a manoeuvre is to take place a member of the crew makes individual decisions regarding the operation of each fin, and the rudder. These are individually controlled by mechanisms inside the hull of the submarine, employing some form of mechanical link to the fin outside the hull.

Conventional construction such as described above suffer from a number of difficulties. Firstly the manoeuvreability of the vehicle is very limited. A second difficulty is that the fins and rudder, particularly when adjusted to make a manoeuvre, create a considerable degree of turbulence in the water resulting in noise from which the submarine can easily be detected and located. A third problem is that if any one of the fins, or the rudder, becomes damaged the submarine becomes crippled.

It is the object of the invention to solve the above difficulties.

BRIEF SUMMARY OF THE INVENTION

This invention provides an underwater vehicle comprising a plurality of fins distributed over its surface, means for manipulating the fins to steer the vehicle, and a control device designed to receive a signal indicating a desired manoeuvre and adapted in response to such a signal to control at least some of the fins accordingly.

The fins may be driven electrically or alternatively by hydraulic means.

By employing a relatively large number of fins as compared with the five referred to above in relation to conventional submarines, and controlling them in unison with each other, automatically in response to a single command signal generated as a result of a decision to change direction, it is believed that considerably enhanced manoeuvreability can be achieved. Furthermore it is believed that the use of a large number of fins rather than a few larger fins will significantly reduce noise. A further advantage is that because of the relatively large number of fins the vehicle can be expected to remain manoeuvreable even if one or more are damaged. Another advantage is that being relatively small it is relatively easy to carry and supply spare fins for replacing any which may be damaged.

The control device preferably includes some mechanism by which it can detect which fins, if any, are malfunctioning. For each manoeuvre it can thus check on the operability of each fin and whether flow separation is occurring at that fin, thereby automatically making a decision on how those fins which are functioning normally should be controlled in order to effect the manoeuvre which the control device has been instructed to perform and advantageously a mechanism is also provided whereby the control device can detect torque applied to each fin by fluid flow, enabling it to deduce the work done by each fin and in this way sensing when a fin is producing the maximum of work on the fluid before the flow pattern over the fin breaks up. In this way maximum work can be obtained from each fin or alternatively the workload can be monitored and spread evenly over all the fins to ensure minimum noise generation due to turbulence.

It is considered advantageous for each fin to have its own actuator which may be mounted actually inside the fin or, in an alternative arrangement somewhere adjacent to it. This makes each fin independent of the others and easy to replace if damaged.

BRIEF DESCRIPTION OF THE DRAWINGS

One way in which the invention may be performed will now be described by way of example with reference to the accompanying schematic drawings in which.

DETAILED DESCRIPTION

Figure 1:
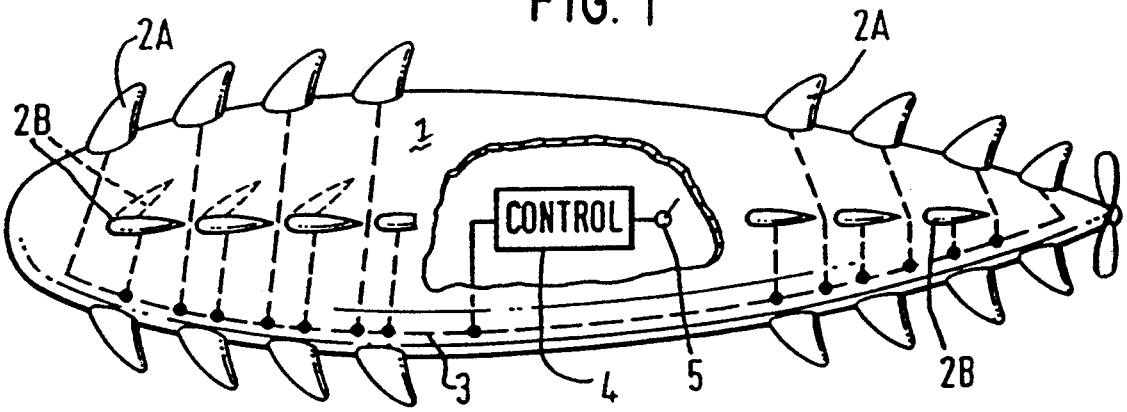
FIG. 1 is a side elevation of a submarine constructed in accordance with the invention, the hull being shown partly broken away to reveal a control station inside.

Referring to FIG. 1 there is shown a submarine having a fore to aft axis lying in the plane of the drawing and passing through the ends of the vessel, a top to bottom axis lying in the plane of the paper and perpendicular to the fore to aft axis, and a port to starboard axis that is perpendicular to the plane of the drawing. The submarine includes a hull 1 and a large number of fore and aft fins 2*a* and 2*b* to control the lateral and vertical direction of the submarine respectively. Both the fore fins 2*b* and the aft fins 2*b* are arranged so as to create "slots" between them as is common aircraft practice thereby creating an improved upward or downward "lift". In an alternative arrangement the fins 2*a* could be given a configuration similar to that of fins 2*b* rather than being arranged linearly from front to back as illustrated.

Each fin is supplied with electrical power by a line 3 connected to a control station 4. This control station has an input device in the form of a joy stick control 5 by which the pilot indicates the manoeuvre which he wishes to perform. Of course in alternative embodiments other input devices could be employed.

Figure 2:
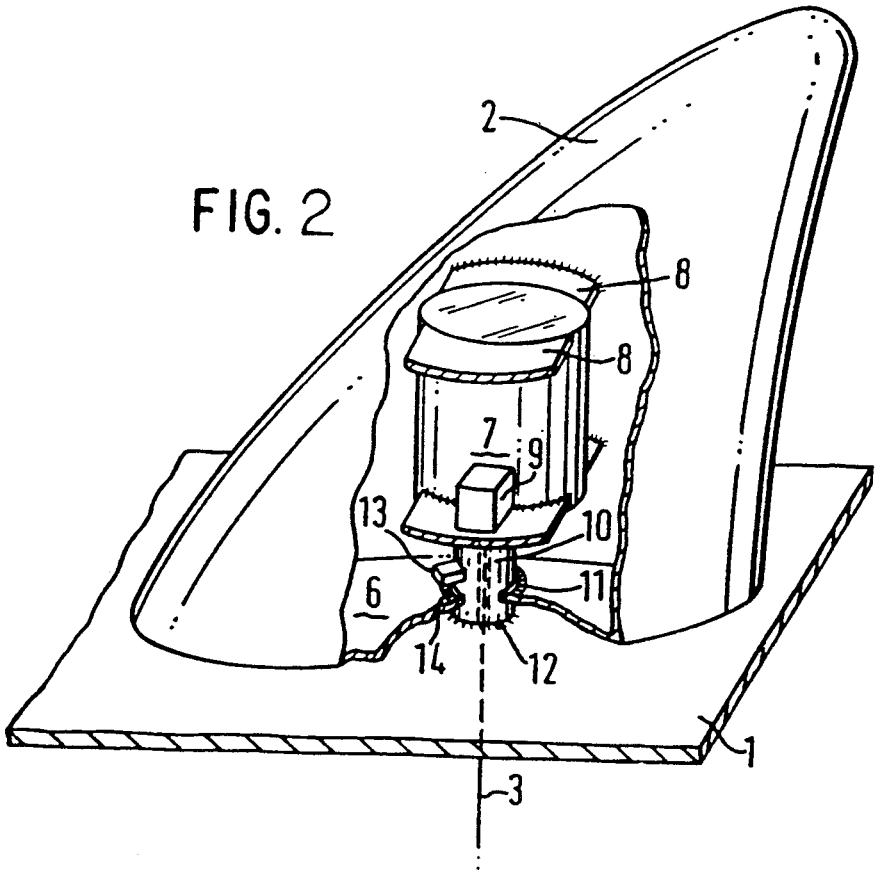
FIG. 2 is a perspective view, again shown partly broken away, of one of the fins of the submarine shown in FIG. 1.

FIG. 2 shows a detail of one of the fins. This is in the form of a hollow casing having shaped sides and a flat base 6. A motor 7 is anchored to the fin sides by brackets 8, one of which also supports a control circuit 9. The motor has a shaft 10 which passes through a seal 11 in the base 6 and is fixed by a weld 12 to the submarine hull 1. Thus the motor and fin rotate whilst the shaft 10 remains stationery. The shaft 10 has, attached to it, a position sensor 13 which co-operates with coded markings 14 on the base 6 to detect the position or attitude of the fin relative to the hull. The sensor 13 communicates with the control station 4 via the line 3.

In response to any adjustment of the joy stick control 5 the control station 4 calculates the desired position of each fin, in accordance with the procedure described below with reference to FIG. 3, and sends a control signal to each fin in turn. This control signal takes the form of a digital message formed by a modulation of the voltage on the power supply line 3. Each such message comprises the address of the fin to be controlled and a code identifying the desired attitude of it. The control circuit 9 of the appropriate fin recognises a message containing its unique address and, in response to such a message, operates the motor 7 within the fin. Operation of the motor continues until the position sensor 13 within the fin sends a message, via the control circuit 9, back along the line 3 indicating that the desired position has been reached. The control station 4 then instructs the fin to stop moving.

If the fin does not reach the desired position, indicating a malfunction, the control station 4 recalculates the positions which the other fins must adopt in order to perform the desired manoeuvre. From FIG. 1 and the foregoing discussion it will be apparent that the submarine has an excess number of fins available for rotating it about its top to bottom axis and for rotating it about its port to starboard axis. Thus malfunction of one or a few fins does not significantly affect performance.

The control circuit 9 as well as monitoring the angular position of the fin relative to the shaft, via sensor 13, also measures the torque applied to the shaft via the motor 7, this information being encoded and returned along the line 3 to the control station. Knowing the position and torque applied to each fin the control station can at all times make good use of the fins available whilst ensuring that the angle of any fin to the direction of fluid flow over it is not so great as to cause break up of the flow pattern over it.

Figure 3:
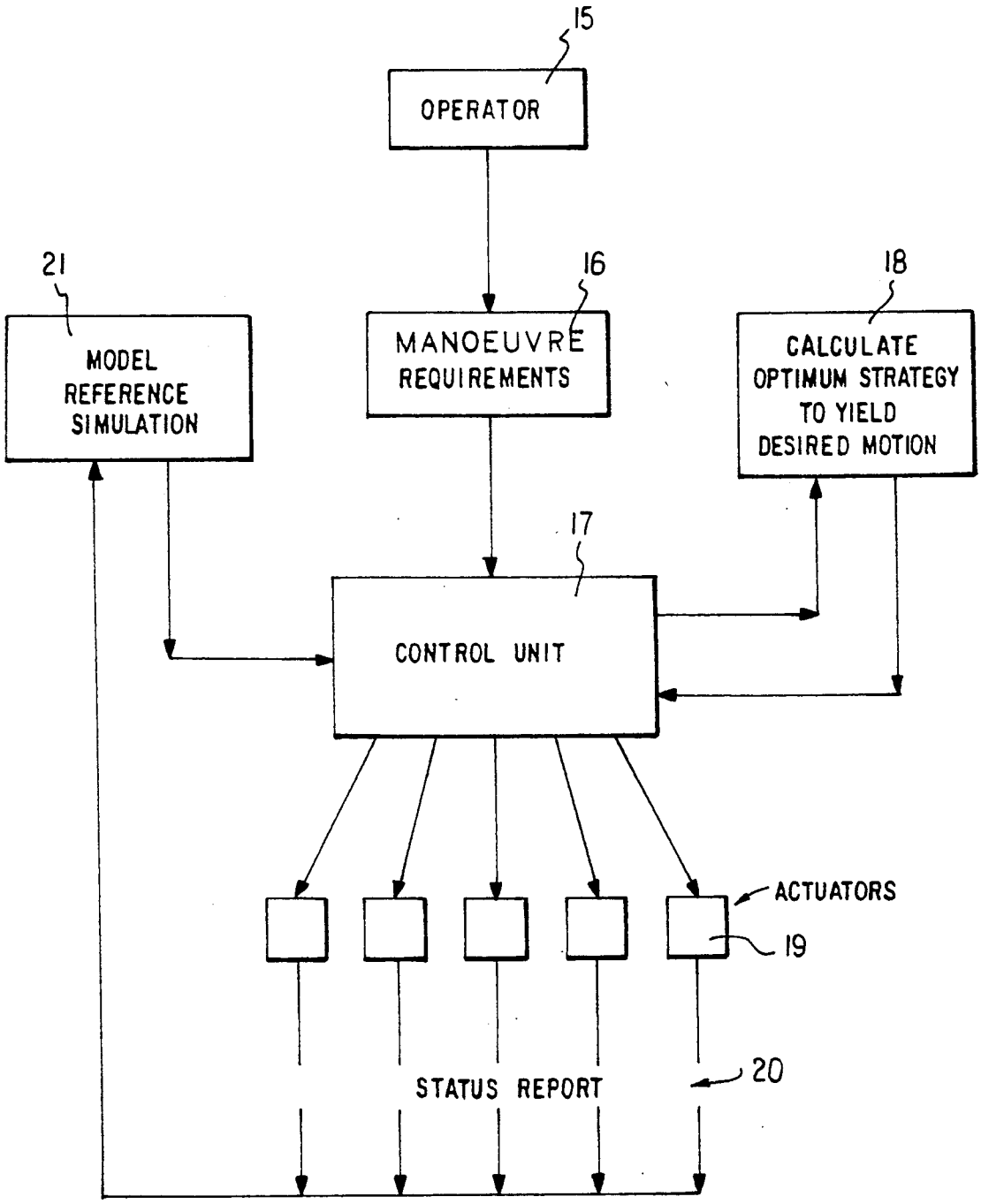
FIG. 3 illustrates the control procedures in schematic block diagram form.

To achieve the above effects the system operates as illustrated in FIG. 3.

An operator 15 inputs his manoeuvre requirements 16 which are received by the central control unit 17. This calculates the optimum strategy to yield the desired motion 18, and appropriate signals are sent to the actuators 19. In turn a status report 20 is received from the actuators, and this is used to produce a model reference simulation 21. In this way any malfunction of an actuator is detected and a new model created accordingly. Also the status report containing torque information reveals if any action is required to reduce excessive loading on particular fins either to avoid fluid flow breakdown or turbulence. In this way the simulation can account for these additional factors and create a new model which the actuators will set the fins to adopt. This enables the trim of the vessel to be constantly monitored to give the best operating charactistics whilst performing any given manoeuvre ensuring that variations in the trim of any fin or fins is not destructively interfering with the flow characteristics about another.

We claim:

1. A manoeuvreable underwater vehicle, comprising:

means for generating a control signal indicating a desired manoeuvre which is to be executed;

a plurality of controllable fins distributed over the surface of said vehicle, the number and distribution of said fins being such that there is an excess number of fins available for performing said desired manoeuvre;

a plurality of fin manipulating means, each fin having associated therewith one of said fin manipulating means; and control means, responsive to said control signal, for controlling at least some of said plurality of fin manipulating means, wherein the control means includes means for detecting which fins if any are malfunctioning, and for adjusting the control of the other fins to take that into account.

2. A manoeuvreable underwater vehicle having a fore to aft axis, a port to starboard axis, and a top to bottom axis, each being mutually perpendicular to the other two, comprising:

means for generating a control signal indicating a desired manoeuvre which is to be executed;

a plurality of controllable fins distributed over the surface of said vehicle, the number and distribution of said fins being such that there is an excess number of fins available for manoeuvrering the vehicle such that it rotates about the top to bottom axis, and an excess number of fins available for manoeuvrering the vehicle such that it rotates about the port to starboard axis;

a plurality of fin manipulating means, each fin having associated therewith one of said fin manipulating means; and control means, responsive to said control signal, for controlling at least some of said plurality of fin manipulating means.

3. An underwater vehicle according to claim 2, wherein the control means comprises means for detecting torque applied to each fin by fluid flow.

4. An underwater vehicle according to claim 2, in which each fin has its own actuator mounted in it.

5. An underwater vehicle according to claim 2, wherein the fins are arranged and shaped such as to form slots.

6. An underwater vehicle as claimed in claim 2, wherein each fin comprises sensing means for generating a report, and wherein the control means is additionally responsive to the reports from the fins and uses the reports in conjunction with the control signal to control the fins when said desired manoeuvre is executed.

7. An underwater vehicle as claimed in claim 2, wherein the number of fins is greater than five.

8. A manoeuvreable underwater vehicle, comprising:

means for generating a control signal indicating a desired manoeuvre which is to be excuted;

a plurality of controllable fins distributed over the surface of said vehicle, the number and distribution of said fins being such that there is an excess number of fins available for performing said desired manoeuvre;

a plurality of fin manipulating means, each fin having associated therewith one of said fin manipulating means; and control means, responsive to said control signal, for controlling at least some of said plurality of fin manipulating means, wherein the vehicle has front and rear ends and left, right, top, and bottom sides, and wherein there are a plurality of fins at the left side of the front end of the vehicle, a plurality of fins at the right side of the front end of the vehicle, a plurality of fins at the top side of the front end of the vehicle, a plurality of fins at the bottom side of the front end of the vehicle, a plurality of fins at the left side of the rear end of the vehicle, a plurality of fins at the right side of the rear end of the vehicle, a plurality of fins at the top side of the rear end of the vehicle, and a plurality of fins at the bottom side of the rear end of the vehicle.

9. An underwater vehicle as claimed in claim 2, wherein each fin comprises a hollow casing; motor means, mounted in the casing and having a shaft which is affixed to the surface of the vehicle, for rotating the fin with respect to the surface; and sensor means in the casing for sensing the angular position of the fin.

* * * * *